US005485676A

United States Patent [19]

Terhorst

[11] Patent Number: 5,485,676

[45] Date of Patent: Jan. 23, 1996

[54] CARPET CUTTING KNIFE GUIDE

[76] Inventor: Mark A. Terhorst, 637 Newton St., Denver, Colo. 80204

[21] Appl. No.: 287,930

[22] Filed: Aug. 9, 1994

[51] Int. Cl.[6] ..... B26B 29/06

[52] U.S. Cl. ..... 30/294; 30/293

[58] Field of Search ..... 30/293, 294, 296.1; 7/103

[56] References Cited

U.S. PATENT DOCUMENTS

| | | | |
|---|---|---|---|
| 4,868,989 | 9/1989 | Renaud | 30/294 X |
| 5,025,924 | 12/1991 | McIlhatten | 30/294 X |
| 5,325,594 | 7/1994 | Szafranski | 30/293 X |

OTHER PUBLICATIONS

Crain Cutter Co., Inc.—"Instruction Manual for Crain #298 Top Cutter".

*Primary Examiner*—Douglas D. Watts

*Attorney, Agent, or Firm*—Thomas C. Naber

[57] ABSTRACT

A carpet cutting knife guide for cutting overlapping adjacent edges of two pieces of carpet to be laid adjacently on a floor. The guide has two lateral members substantially parallel to each other and spaced from each other. A platform member extends from the first lateral member to the second lateral member and has an opening through which at least a blade of a carpet cutting knife member can pass to thereafter be positioned substantially at the floor. The opening has in conjunction therewith at least one friction fit means whereby a portion of the knife member can be releasably retained. The platform member is constructed of a flexible material such that exerting a force thereon causes the knife member to limitedly move substantially perpendicularly toward the floor. Wheels are provided for manually moving the guide over the overlapping edges of the carpet to be cut. Construction of the knife guide permits an operator to efficiently and precisely cut overlapping edges of two pieces of carpet simultaneously and then allows the resulting cut edges to fall into place adjacent each other in a clean and substantially identical seam-line pattern.

11 Claims, 1 Drawing Sheet

CARPET CUTTING KNIFE GUIDE

BACKGROUND OF THE INVENTION

This invention relates in general to a device for cutting carpet, and in particular to a carpet cutting knife guide for cutting overlapping adjacent edges of two pieces of carpet to be laid adjacent each other such that the adjacent cut edges after cutting abut substantially identically with respect to each other.

In the process of laying carpet, it is many times necessary to use more than one piece of carpet to cover the floor of an entire room. This requirement may be due to the size of a room, to the shape of a room, or to the need to efficiently use various sizes of individual pieces of carpet. One usual approach in piecing together two pieces of carpet is to first measure the space to be covered and then to cut with a knife each piece of carpet individually from its backside according to the measurements earlier taken. Such an approach is known in the art as "straight-edging." While this approach provides two pieces of carpet that, when joined, are quite accurate as to overall dimensions of the room to be carpeted, the site where the adjacent edges of the two pieces actually meet, sometimes called the "seam line," may present an uneven match. The primary cause for such an uneven meeting is due to inaccuracies and difficulties in cutting an exactly-identical dimensional line of fibers in two separate pieces of carpet. Other causes include carpet pieces shifting when folded back into glue after being cut from the backside, and a waviness characteristic occurring upon adherence to the floor which results in the originally-adjacent edges not meeting as earlier experienced. When this occurs, the carpet installer is forced to either stretch or trim one or both pieces of carpet to try and achieve a straight seam line, or to discard the carpet and repeat the procedure with replacement carpet. Both approaches can be very costly, either in respect to labor or to both labor and material.

It therefore is apparent that a need is present for a carpet cutting device that accomplishes uniform cutting of two pieces of carpet whose edges are to be adjacent each other after installation of the carpet is completed.

Accordingly, a primary object of the present invention is to provide a carpet cutting knife guide that permits a carpet installer to simultaneously cut overlapping adjacent edges of two pieces of carpet that ultimately will be adjacent each other, thereby creating exactly-identical dimensional lines of cut fibers in two separate pieces of carpet.

Another object of the present invention is to provide a carpet cutting knife guide whose characteristics permit flexibility of movement and ease of travel over the overlapping adjacent edges as a clean and uniform cut of both carpet pieces is accomplished.

These and other object of the present invention will become apparent throughout the description of the invention which now follows.

SUMMARY OF THE INVENTION

The present invention is a carpet cutting knife guide for cutting overlapping adjacent edges of two pieces of carpet to be laid adjacently on a floor. The knife guide comprises a first lateral member and a second lateral member substantially parallel to each other and spaced from each other. A platform member, substantially parallel with the floor, extends from the first lateral member to the second lateral member and is attached to the first and second lateral members. The platform member has an opening through which at least a blade of a carpet cutting knife member having a proximal handle and a distal blade can pass to thereafter be positioned substantially at the floor. The opening has in conjunction therewith at least one friction fit means whereby a portion of the knife member can be releasably retained. The platform member is constructed of a flexible material such that exerting a force by hand on the releasably retained knife member or on the flexible platform member itself causes the knife member to limitedly move substantially perpendicularly toward the floor when the force is exerted. Movement means extend substantially perpendicularly from and are attached to each of the lateral members for manually moving the guide over the overlapping edges of the carpet to be cut. In the preferred embodiment, the platform member is spring steel and the movement means are a plurality of wheels mounted on each of the lateral members. The construction of the present carpet cutting knife guide, which may be referred to in the trade as a "double cutter" because two pieces of carpet are cut simultaneously, permits an operator to efficiently and precisely cut overlapping edges of two pieces of carpet concurrently and then allows the resulting cut edges to fall into place adjacent each other in a clean and substantially identical seam-line pattern.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
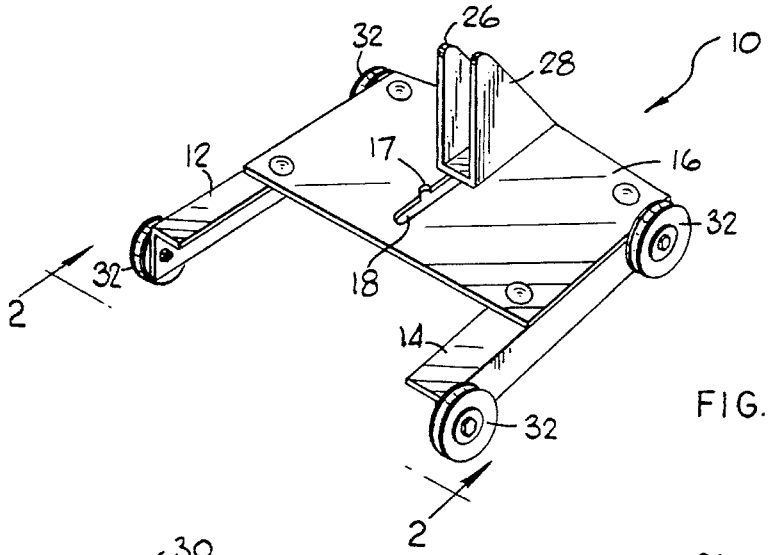
FIG. 1 is a perspective view of a carpet cutting knife guide.
Figure 2:
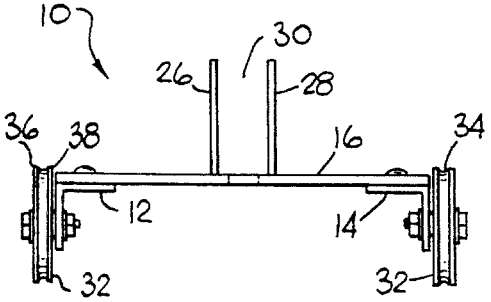
FIG. 2 is an elevation view along line 2—2 of FIG. 1.

Referring to FIGS. 1–4, a carpet cutting knife guide 10 is illustrated. The guide 10 has a first L-shaped lateral member 12 and a second L-shaped lateral member 14, each substantially parallel to each other and spaced from each other. The lateral members 12, 14 are constructed of iron. A platform member 16 extends from the first lateral member 12 to the second lateral member 14 and is attached by being bolted to the respective top portions of the first and second lateral members 12, 14. The platform member 16 is constructed of spring steel to have a spring characteristic of steel found in a typical hand saw such as that found in general purpose hand saw Model No. 36100, manufactured by Sears, Roebuck and Co., Chicago, Ill. An opening 18 extends through the platform 16. A knife member 20 having a distal blade 24 extending from a proximal handle 22 is positioned within the opening 18 (FIGS. 3 and 4) such that the blade 24 is substantially contactable with a floor beneath and/or with carpet to be cut. A preferred knife member 20 is Model No. 720, manufactured by Crain Cutter Co., Inc., Milpitas, Calif., whose handle 22 has a thicker upper portion and a thinner lower portion for complimentary beneficial friction-fit placement in the knife guide 10 as explained below.

While only one friction fit means is required, the preferred embodiment here shown has two friction fit means that function to releasably retain the knife member 20 in place during operation of the knife guide 10. Specifically, the opening 16 is sized such that its opposing side walls thereby grasp by friction fit, upon knife-member insertion, a portion of the handle 22 of the knife member 20 immediately proximal from the blade 24. A cut-out 17 is provided to the opening 16 to thereby accommodate a projecting screw of the handle 22.

Figure 3:
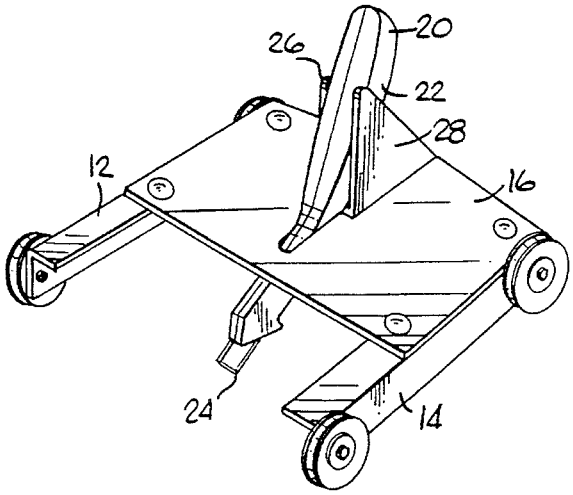
FIG. 3 is a perspective view of the carpet cutting knife guide of FIG. 1 with a knife member in place.
Figure 4:
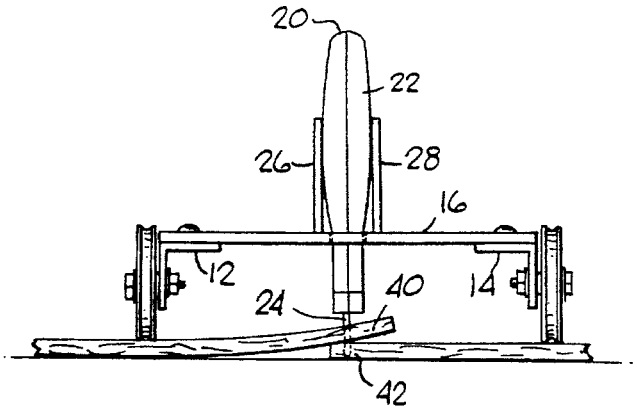
FIG. 4 is an elevation view of the carpet cutting knife guide with knife member in place of FIG. 3 in an operational position over overlapping edges of two pieces of carpet to be laid.

A second friction fit means extends upwardly substantially perpendicularly from the platform member 16 and comprises a first flange member 26 and a second flange member 28 substantially parallel to each other and spaced from each other a sufficient distance to thereby provide a space 30 there between within which an upper portion of the handle 22 of the knife member 20 can be releasably retained by a friction fit. FIGS. 3 and 4 illustrate the knife member 20 being releasably retained in this manner. Where a single friction fit means is employed, that created by the opposing side walls of the opening 16 is found to be the more beneficial.

Each of the lateral members 12, 14 has as movement means two attached wheels 32 mounted thereon and extending substantially perpendicularly toward the floor for manually moving the guide 10. Each wheel 32 has a concave perimeter 34, here a V-shape, to thereby present two rolling surfaces 36, 38 as the guide 10 travels along overlapping adjacent carpet edges 40, 42 as illustrated in FIG. 4. This concave perimeter 34 accommodates carpet nap as the guide 10 is rolled on the carpet to thereby improve traction and direction of the guide 10 while in use.

Figure 5:
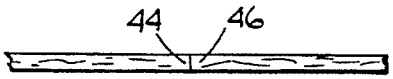
FIG. 5 is an elevation view of adjacent resulting edges of the two pieces of carpet of FIG. 4 after being cut.

In operation, a carpet installer first positions two pieces of carpet whose adjacent edges initially overlap and are to be ultimately abutting each other after the carpet is installed. The pieces of carpet are dimensioned such that the adjacent edges initially slightly overlap each other, as illustrated in FIG. 4. The pieces of carpet are glued to the floor prior to cutting the overlapping edges. After initial carpet placement is accomplished, the operator positions the knife guide 10, with the knife member 20 held in place by friction fit and the tip of the blade 24 in contact with the carpet, over the overlapping edges. Guide placement is such that a portion of each edge of the carpet is directly beneath the blade 24, as shown in FIG. 4. Thereafter, the operator exerts downward pressure by hand on the platform 16 while simultaneously manually moving the guide 10 via its wheels 34 along the path of the overlapping carpet edges. Because the platform 16 is flexible and of adequate width (preferably about 7 inches [18 cm]) to accommodate the hands of a user as the user applies downward pressure, the platform's flexibility provides a sense of "feel" to the tool as well as a constant substantially-perpendicular orientation of the blade 24, with the latter accomplishing clean, uniform cuts through both carpet edges. Thus, the user can literally feel the floor beneath the carpet being cut, can simultaneously sense the perpendicular blade placement, and can track well on the carpet surface as the carpet nap fills the respective concave perimeters 34 of the wheels 32. Such operation results in the tip of the blade 24 cutting through both of the overlapping edges and thereby removing a strip of edge from each carpet piece. Because a simultaneous cut of both edges occurs with the same stroke of the knife blade, the resulting new adjacent carpet edges 44, 46 (FIG. 5) have substantially identical cut-patterns. Consequently, when these cut edges are placed next to each other for final placement, they match substantially perfectly, as illustrated in FIG. 5, and present a clean seam line which is potentially invisible depending on the nap of the carpet. In this manner a carpet installer is able to efficiently install carpet without economic loss or poor workmanship.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

I claim:

1. A carpet cutting knife guide for cutting overlapping adjacent edges of two pieces of carpet to be laid adjacently on a floor, the guide comprising:

a) a first lateral member and a second lateral member substantially parallel to each other and spaced from each other;

b) a platform member extending from the first lateral member to the second lateral member and attached to the first and second lateral members, the platform member being substantially parallel with the floor and having an opening through which at least a blade of a carpet cutting knife member having a proximal handle and a distal blade can pass, with said opening having in conjunction therewith at least one friction fit means whereby a portion of the knife member can be releasably retained, with said platform member constructed of a flexible material such that exerting a force on the handle of the releasably retained knife member or on the platform member causes the knife member to limitedly move substantially perpendicularly toward the floor when said force is exerted; and c) movement means extending substantially perpendicularly from and attached to each of the lateral members for manually moving the guide over the overlapping edges of the carpet to be cut.

2. A carpet cutting knife guide as claimed in claim 1 wherein the platform member is constructed of spring steel.

3. A carpet cutting knife guide as claimed in claim 2 wherein a friction fit means comprises opposing side walls of the opening between which a portion of the handle can be retained by friction fit.

4. A carpet cutting knife guide as claimed in claim 3 wherein a second friction fit means comprises a first flange member and a second flange member substantially parallel to each other, extending substantially perpendicularly from the platform member, and spaced from each other a sufficient distance to thereby provide an opening there between within which a portion of the handle of the knife member can be releasably retained by a friction fit.

5. A carpet cutting knife guide as claimed in claim 1 wherein a friction fit means comprises opposing side walls of the opening between which a portion of the handle can be retained by friction fit.

6. A carpet cutting knife guide as claimed in claim 5 wherein a second friction fit means comprises a first flange member and a second flange member substantially parallel to each other, extending substantially perpendicularly from the platform member, and spaced from each other a sufficient distance to thereby provide an opening there between within which a portion of the handle of the knife member can be releasably retained by a friction fit.

7. A carpet cutting knife guide as claimed in claim 1 wherein the movement means comprises a plurality of wheels.

8. A carpet cutting knife guide as claimed in claim 5 wherein the movement means comprises a plurality of wheels.

9. A carpet cutting knife guide as claimed in claim 6 wherein the movement means comprises a plurality of wheels.

10. A carpet cutting knife guide as claimed in claim 8 wherein the wheels have a concave perimeter.

11. A carpet cutting knife guide as claimed in claim 9 wherein the wheels have a concave perimeter.

* * * * *